United States Patent [19]

Pepper

[11] Patent Number: 4,553,356

[45] Date of Patent: Nov. 19, 1985

[54] RAINWATER GUTTER SEALING ARRANGEMENT

[75] Inventor: Kenneth V. Pepper, Elkhart Lake, Wis.

[73] Assignee: Bemis Manufacturing Company, Sheboygan Falls, Wis.

[21] Appl. No.: 587,705

[22] Filed: Mar. 8, 1984

[51] Int. Cl.[4] ..... E04D 13/06

[52] U.S. Cl. ..... 52/11; 52/12; 52/95; 52/403

[58] Field of Search ..... 52/11, 12, 13, 14, 15, 52/16, 94, 95, 96, 393, 394, 395, 397, 400, 403

[56] References Cited

U.S. PATENT DOCUMENTS

| | | | |
|---|---|---|---|
| 2,988,226 | 6/1961 | Campbell | 52/12 X |
| 3,612,453 | 10/1971 | Zimmer | 52/11 X |
| 3,759,004 | 9/1973 | Kent | 52/403 X |
| 3,788,022 | 1/1974 | Epperlein et al. | 52/403 |
| 3,837,130 | 9/1974 | Hildebrandt et al. | 52/403 X |
| 4,345,731 | 8/1982 | Rowe | 52/95 X |

FOREIGN PATENT DOCUMENTS

| | | | |
|---|---|---|---|
| 1956791 | 5/1971 | Fed. Rep. of Germany | 52/11 |
| 1503890 | 10/1967 | France | 52/11 |
| 2526836 | 11/1983 | France | 52/11 |

*Primary Examiner*—Donald G. Kelly
*Assistant Examiner*—Richard E. Chilcot, Jr.
*Attorney, Agent, or Firm*—Dressler, Goldsmith, Shore, Sutker & Milnamow, Ltd.

[57] ABSTRACT

A sealing arrangement for a rainwater gutter assembly is disclosed which acts to substantially prevent the passage of water between a gutter of the assembly and its generally adjacent supporting surface. The sealing arrangement comprises a unitary, elongated sealing strip including a flexible sealing lip portion adapted to sealingly engage the associated surface, and a joining portion adapted to receive an upper edge portion of the gutter. Notably, the sealing strip preferably comprises a co-extrusion of materials exhibiting differing flexibility. In this manner, the sealing lip of the strip is formed of a relatively flexible material, while the joining portion of the strip preferably comprises a relatively rigid material.

5 Claims, 3 Drawing Figures

RAINWATER GUTTER SEALING ARRANGEMENT

TECHNICAL FIELD

The present invention relates generally to rainwater gutter assemblies and the like, and more particularly to a unitary sealing strip arrangement for spanning the gap between a gutter and an associated supporting surface, with the sealing strip preferably comprising a co-extrusion of relatively flexible and relatively rigid materials.

BACKGROUND OF THE INVENTION

A gutter assembly is typically provided near the roof of a structure for collecting the rainwater which runs off of the roof. The gutter is typically joined to a downspout or the like for channeling the rainwater away from the structure. While in the past gutters have typically comprised suitably channel-shaped wood or metal, the use of plastic gutter assemblies is becoming increasingly widespread in view of their corrosion-resistance, ease of installation, and durability.

In order for a gutter assembly to perform its intended function, it is necessary that the water which flows from the roof of a structure be channeled into the gutter for collection. To this end, a so-called "drip edge" is typically provided at the edge of a roof so as to extend beyond the gutter-supporting surface therebeneath, with rainwater thus flowing over the drip edge into the gutter. By such an arrangement, the passage of water between any gap which may exist between the supporting surface and the gutter is avoided.

While most roofs typically include a drip edge as described above, it is not uncommon to encounter existing structures wherein the drip edge is broken or corroded, or otherwise in a condition which would prevent discharge of water run-off into a gutter. Similarly, it is also possible to encounter roof structures wherein drip edges have not been provided, or where existing drip edges are not adequately dimensioned to span any gap between the gutter and the generally adjacent supporting surface.

Accordingly, it is desirable to provide a sealing arrangement for a gutter assembly for spanning the gap between a gutter and its associated supporting surface to substantially prevent passage of water therebetween.

SUMMARY OF THE INVENTION

In accordance with the present invention, a desirably straightforward sealing arrangement is provided for effecting a seal between an upper edge portion of a generally channel-shaped gutter and its associated supporting surface. The sealing arrangement comprises a unitary, elongated sealing strip which is preferably configured for convenient "snap-fitting" to the upper edge of the gutter, with the strip including a sealing lip portion which is adapted to sealingly engage the associated supporting surface. To assure the integrity of the arrangement, the sealing strip preferably comprises a co-extrusion of relatively flexible and relatively rigid materials, with the sealing lip comprising the relatively flexible one of the materials.

For purposes of illustration, the present sealing arrangement is disclosed in association with a plastic gutter assembly, including a generally U-shaped, channel-like gutter having at least one continuous rib on the inwardly facing surface of an upper edge portion thereof. A pair of such ribs are shown on each upper edge portion of the illustrated gutter, with the ribs thus respectively defining a pair of grooves for holding a leaf screen in a position to span the gutter. Notably, the present sealing arrangement can be readily configured to retain this screen-holding capability of the gutter assembly.

The elongated sealing strip of the present invention comprises a joining portion which defines a generally downwardly opening groove for receiving the upper edge portion of the gutter. The joining portion further preferably includes means for retaining the gutter edge portion in the receiving groove, which in the illustrated embodiment comprises a retaining rib which coacts with the one of the screen-holding ribs of the gutter. In order to hold an associated leaf screen in position across the gutter, the joining portion of the sealing strip preferably defines a holding groove which opens generally inwardly of the gutter for holding an edge of the leaf screen.

The sealing lip of the sealing strip is adapted to continuously sealingly engage the surface upon which the gutter assembly is supported, and thereby span any gap which may exist between the gutter and the associated supporting surface. In the preferred form, the sealing lip extends generally upwardly of the joining portion of the sealing strip, and tapers to a free edge of substantially reduced dimension. By this construction, the sealing lip is adapted to flex upwardly when seated against the associated supporting surface, and thus guide water away from the supporting surface and into the gutter.

In order to enhance the sealing effectiveness of the arrangement without compromise of its structural integrity, the sealing strip of the present invention preferably comprises a co-extrusion of materials exhibiting differing degrees of flexibility. Accordingly, the sealing lip of the sealing strip preferably comprises a first material which exhibits a greater modulus of elasticity, and therefore is of relatively greater flexibility, than a second material which forms the joining portion of the sealing strip. In other words, the sealing strip comprises a first relatively flexible material and a second relatively rigid material, with the sealing lip of the strip comprising the first relatively flexible material. This preferred configuration of the present invention takes advantage of known techniques for co-extruding materials to provide a construction which is sufficiently rigid for firm attachment to an associated gutter, while at the same time being of sufficient flexibility to effect good sealing against the associated gutter-supporting surface.

Other advantages and features of the present invention will become readily apparent from the following detailed description, the accompanying drawings, and the appended claims.

DETAILED DESCRIPTION

Figure 1:
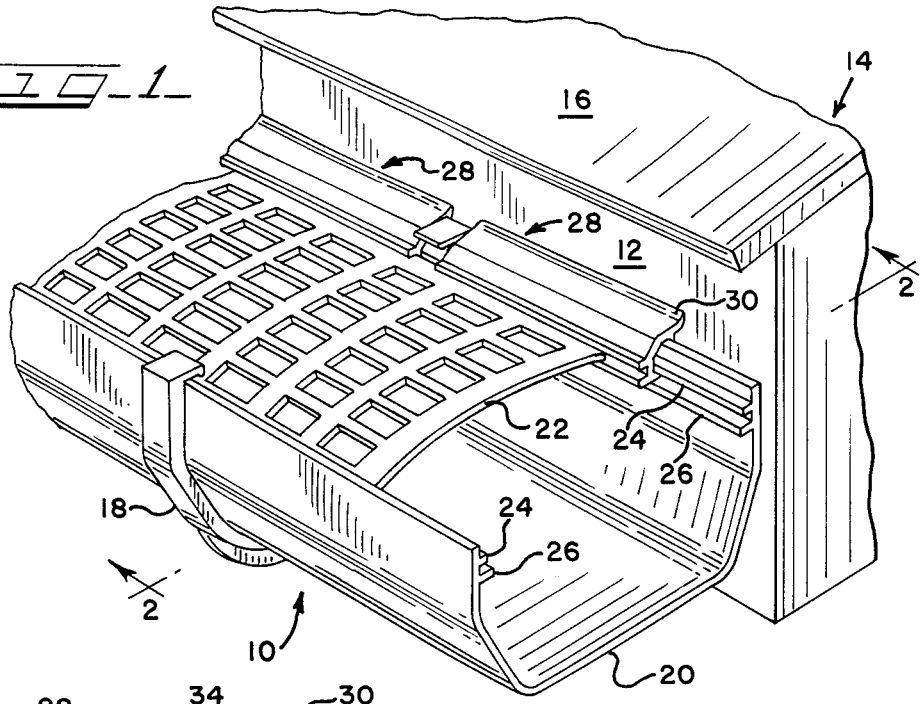
FIG. 1 is a perspective view, in partial cutaway, illustrating a gutter assembly mounted on an associated structure, with a sealing arrangement embodying the principles of the present invention positioned in association therewith.

While the present invention is susceptible of embodiment in various forms, there is shown in the drawings, and will hereinafter be described, a presently preferred embodiment, with the understanding that the present disclosure is to be considered as an exemplification of the invention, and is not intended to limit the invention to the specific embodiment illustrated.

Referring first to FIG. 1, therein is illustrated a gutter assembly 10 shown mounted on a supporting surface 12 of an associated structure 14. Structure 14 includes a roof 16 which is illustrated in a typically sloping configuration, with the roof 16 extending slightly beyond the supporting surface 12. As will be recognized by those familiar with building construction, the supporting surface 12 may be referred to as the fascia or fascia board in some instances.

Gutter assembly 10 has been illustrated in the typical configuration of a plastic gutter assembly. While such plastic gutters are becoming increasingly popular for their ease of installation and low maintenance, it is to be understood that the sealing arrangement of the present invention is equally suited for use with gutters which are of non-plastic construction.

The gutter assembly includes a plurality of spaced gutter brackets 18 (one being shown) which are suitably affixed to supporting surface 12 with nails, screws, or like mechanical fasteners (not shown). The assembly further includes a channel-shaped elongated gutter 20, which is illustrated with a typically U-shaped cross-sectional configuration. In the case of a plastic gutter assembly, gutter 20 is of suitable plastic material, and is held in position within the gutter brackets 18. The typical plastic gutter assembly does not employ fasteners of the like for connecting the gutter to the gutter brackets, but rather has the gutter 20 retained by the gutter brackets 18 such that the gutter 20 can expand and contract along its length in response to temperature.

Since leaves, twigs, and other debris could impede the flow of rainwater within the gutter 20, gutter assembly 10 is illustrated as including a leaf screen 22 which spans the gutter 20. To this end, each of the upper edge portions of the gutter 20 is configured to hold the leaf screen 22 in position, and accordingly, each edge portion includes a pair of ribs 24 and 26 disposed on the respective inwardly facing surfaces of the upper gutter edge portions.

An elongated sealing strip 28 embodying the principles of the present invention is joined to one of the edge portions of gutter 20 for spanning the gap between the edge portion and the associated supporting surface 12. Sealing strip 28 includes a continuous sealing lip portion 30 which is adapted to sealingly engage the associated supporting surface 12. Sealing lip portion 30 preferably extends generally upwardly to a free edge which is adapted to contact supporting surface 12, with this preferred configuration accommodating flow of water away from surface 12 and into gutter 20.

Figure 3:
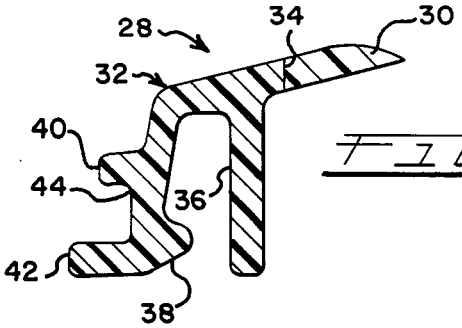
FIG. 3 is an enlarged, cross-sectional view of the present gutter sealing strip arrangement.
Figure 2:
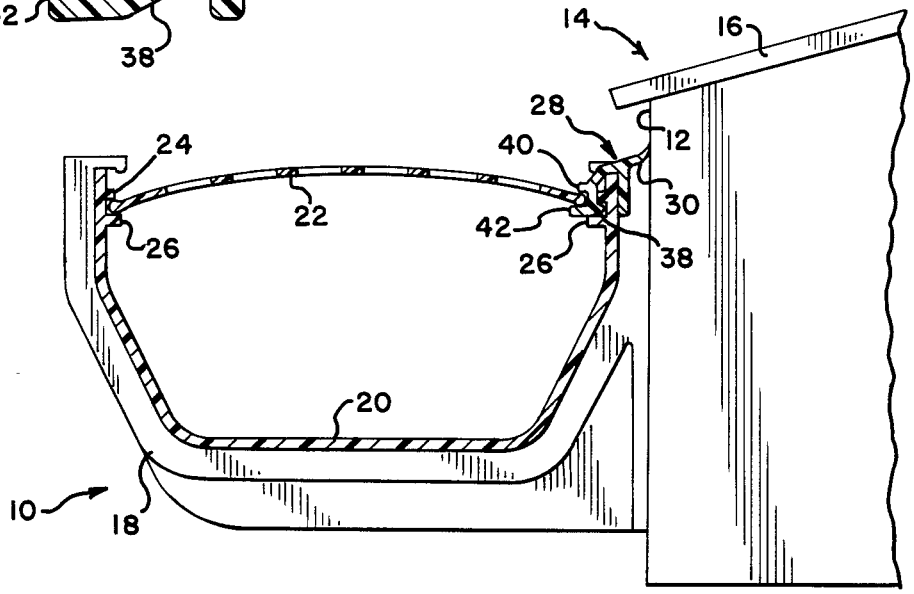
FIG. 2 is a cross-sectional view further illustrating the gutter assembly, sealing arrangement, and associated structure shown in FIG. 1.

The sealing strip 28 further includes a joining portion, generally designated 32, for securely joining the sealing strip to the upper edge portion of the gutter 20. In keeping with the preferred configuration for the sealing strip 28, it is important to note that sealing lip portion 30 of the strip 28 comprises a first relatively flexible material, while the joining portion 32 comprises a second relatively rigid material. To achieve this, the sealing strip 28 preferably comprises a co-extrusion of the first and second materials, with a material interface being provided preferably at 34 (FIG. 3).

Techniques for efficiently co-extruding materials are known whereby this desirable configuration of the sealing strip can readily be effected. By way of example, the extrusion can comprise polyvinyl chloride resin, suitably compounded with stabilizers, lubricants, and other additives to form a weather-resistant rigid compound for formation of joining portion 32, with a similar compound to which plasticizer has been added employed for formation of sealing lip portion 30. The compatibility of such compounded vinyl resins enables two separate streams of material to be fed into a single extrusion die, wherein the adjacent faces unite to form an extrusion having a single profile with areas of differing hardness. As will be recognized, elastomers other than polyvinyl chloride compounds can be readily co-extruded to unite with other rigid compounds, and thus provide a single extrusion exhibiting the desired flexible/rigid characteristics and weather-resistance.

The joining portion 32 of sealing strip 28 is configured for convenient attachment to the upper edge portion of gutter 20, preferably in the nature of a "snap-fit". Accordingly, the configuration of the joining portion 32 can be varied, depending upon the configuration of the gutter 20, in keeping with the principles disclosed herein. The joining portion 32 is preferably configured for receiving the upper edge portion of the gutter 20, and to this end preferably defines a generally downwardly opening receiving groove 36 which receives the upper edge portion of the gutter 20 along the length of the sealing strip 28.

The joining portion 32 of strip 28 is further preferably configured for retaining the edge portion of gutter 20 within receiving groove 36, and to this end, a retaining rib 38 is preferably provided which extends generally into groove 36 for coaction with the rib 24 provided on the inner surface of gutter 20. The downwardly facing surface of the retaining rib 38 preferably slopes downwardly in a direction away from the edge of gutter 20 received in groove 36. Thus, the groove 36 is urged or "cammed" open by abutment of rib 24 against the lower surface of retaining rib 38, with the rib 38 subsequently fitting beneath the rib 24 of the gutter. The preferred snap-fit of the sealing strip 28 to the gutter 20 is thus provided, with the preferred relatively rigid construction of joining portion 32 assuring the integrity of the snap-fit.

As will be appreciated, it is of course preferred that use of sealing strip 28 not preclude the use of leaf screen 22 in the assembly. Accordingly, the sealing strip 28 preferably includes means for holding an edge portion of the associated leaf screen. To this end, the receiving portion 32 of the strip 28 includes a pair of screen ribs 40 and 42 which together define a screen-holding groove 44 which opens generally inwardly of gutter 22. The groove 44 is thus adapted to receive the screen 22 to prevent the undesired accumulation of leaves and other debris in the gutter 22.

From the foregoing, it will be observed that numerous modifications and variations can be effected without departing from the true spirit and scope of the novel concept of the present invention. It will be understood that no limitation with respect to the specific embodiment illustrated herein is intended or should be inferred. It is, of course, intended to cover by the appended claims all such modifications as fall within the scope of the claims.

What is claimed is:

1. A sealing arrangement for a rainwater gutter positioned generally adjacent to an associated supporting surface of a structure, wherein the gutter includes at least one rib on the inwardly facing surface of an upper edge portion thereof, the sealing arrangement comprising:

elongated, unitary sealing means comprising a single extrusion adapted to span a gap between the gutter and the supporting surface, said sealing means comprising means for joining said sealing means to the upper edge portion of the gutter including a generally downwardly opening groove for receiving the gutter edge portion, and means for retaining the gutter edge portion in said receiving groove comprising retaining rib means extending generally into said groove for coacting with the gutter rib to urge said groove open and thereby effect a snap-fit of said sealing means to said upper edge portion, said sealing means further comprising sealing lip means extending integrally from said joining means for sealingly engaging the supporting surface to substantially prevent water from passing between the gutter and the associated supporting surface, said sealing means further comprising means for holding an associated screen in a position which generally spans the gutter including a pair of screen ribs provided on said joining means which together define a screen groove opening generally inwardly of the gutter.

2. A gutter sealing arrangement in accordance with claim 1, wherein, said sealing means comprises a co-extrusion of a first relatively flexible material and a second relatively rigid material, said sealing lip means comprising said first material.

3. A sealing arrangement for a rainwater gutter positioned generally adjacent to an associated supporting surface of a structure, comprising:

elongated unitary sealing means comprising a single extrusion adapted to span a gap between the gutter and the supporting surface, said sealing means comprising means for joining said sealing means to the gutter along the length of said sealing means including means defining a downwardly opening groove for receiving an upper edge portion of said gutter, and retaining means adapted to cooperate with said upper edge portion of said gutter for urging said groove open and for retaining said edge portion in the receiving groove by a snap-fit connection, said sealing means further comprising relatively flexible sealing lip means joined integrally with and extending from said joining means to sealingly engage the associated surface to substantially prevent water from passing between the gutter and the associated surface, said sealing lip means comprising a first material which exhibits a greater modulus of elasticity than a second material from which said joining means is formed.

4. A gutter sealing arrangement in accordance with claim 3, wherein said sealing means comprises a co-extrusion of said first and second materials.

5. A gutter sealing arrangement in accordance with claim 3, including means for holding an associated screen in a position which generally spans the gutter comprising a screen groove defined by said joining means and opening generally inwardly of said gutter.

* * * * *